US009923297B2

(12) United States Patent
Sekino et al.

(10) Patent No.: US 9,923,297 B2
(45) Date of Patent: Mar. 20, 2018

(54) CONNECTOR

(71) Applicant: YAZAKI CORPORATION, Tokyo (JP)

(72) Inventors: Tetsuya Sekino, Shizuoka (JP); Nobuyuki Sakamoto, Shizuoka (JP); Toshinori Yamamoto, Shizuoka (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 15/658,477

(22) Filed: Jul. 25, 2017

(65) Prior Publication Data

US 2018/0034187 A1 Feb. 1, 2018

(30) Foreign Application Priority Data

Jul. 29, 2016 (JP) ..... 2016-149195

(51) Int. Cl.

| | |
|---|---|
| ***H01R 13/436*** | (2006.01) |
| ***H01R 13/502*** | (2006.01) |
| ***H01R 13/62*** | (2006.01) |
| ***H01R 24/28*** | (2011.01) |
| ***H01R 13/641*** | (2006.01) |
| ***H01R 13/627*** | (2006.01) |
| ***H01R 13/639*** | (2006.01) |
| *H01R 103/00* | (2006.01) |

(52) U.S. Cl.

CPC ..... *H01R 13/4368* (2013.01); *H01R 13/502* (2013.01); *H01R 13/62* (2013.01); *H01R 13/6271* (2013.01); *H01R 13/639* (2013.01); *H01R 13/641* (2013.01); *H01R 24/28* (2013.01); *H01R 2103/00* (2013.01)

(58) Field of Classification Search

CPC .. H01R 13/4368; H01R 13/502; H01R 13/62; H01R 13/6271; H01R 13/641; H01R 24/28; H01R 2103/00; H01R 13/639

USPC ..... 439/368, 299, 350, 352, 357, 358

See application file for complete search history.

(56) References Cited

U.S. PATENT DOCUMENTS

| | | | | |
|---|---|---|---|---|
| 6,368,164 | B1 * | 4/2002 | Nakamura | H01R 13/4362 439/489 |
| 6,491,542 | B1 * | 12/2002 | Zerebilov | H01R 13/4226 439/352 |
| 6,840,790 | B2 * | 1/2005 | Endo | H01R 13/641 439/352 |

(Continued)

FOREIGN PATENT DOCUMENTS

JP 2007-128743 A 5/2007

*Primary Examiner* — Tulsidas C Patel
*Assistant Examiner* — Travis Chambers
(74) *Attorney, Agent, or Firm* — Sughrue Mion, PLLC

(57) ABSTRACT

A connector includes a first housing having a first fitting part, a second housing having a second fitting part configured so as to be fittable to the first fitting part, a fitting detection member assembled to an outer circumference of the second housing so as to be movable between a temporary locking position and a primary locking position, an engaged part provided on the second fitting part, and an engaging part which is provided on the fitting detection member so as to be abuttable on the first fitting part and also engaged to the engaged part to hold the fitting detection member at the temporary locking position and the primary locking position to the second housing. The second fitting part and the engaging part are accommodated in the first fitting part.

6 Claims, 17 Drawing Sheets

(56) References Cited

U.S. PATENT DOCUMENTS

| | | | | |
|---|---|---|---|---|
| 6,918,783 | B2 * | 7/2005 | Endo | H01R 13/6272 439/352 |
| 7,559,787 | B2 * | 7/2009 | Shigeta | H01R 13/6272 439/358 |
| 9,142,919 | B2 * | 9/2015 | Osada | H01R 13/6272 |
| 2007/0105420 | A1 | 5/2007 | Shigeta et al. | |

* cited by examiner

CONNECTOR

CROSS REFERENCE TO RELATED APPLICATION

The present application is based on, and claims priority from Japanese Patent Application No. 2016-149195, filed Jul. 29, 2016, the disclosure of which is hereby incorporated by reference herein in its entirety.

TECHNICAL FIELD

The present application relates to a connector, and more particularly to a connector having a first housing and a second housing that can be fitted to each other and a fitting detection member for detecting the fitting state between the first housing and the second housing.

BACKGROUND ART

As a connector in the conventional example, there is known a connector that includes a male connector housing as a first housing having a first fitting part, a female connector housing as a second housing having a second fitting part which is fittable to the first fitting part, and a fitting detection member assembled to the outer circumference of the female connector housing so as to be movable between a temporary locking position and a primary locking position (see US 2007/0105420 A1).

In the conventional connector, the fitting detection member is provided with a locking claw as a locking part which is locked to a connecting part as a locked part of the female connector housing to hold the fitting detection member at the temporary locking position and the primary locking position to the female connector housing and which is abuttable on the male connector housing.

In the conventional connector, with the male connector housing fitted to the female connector housing, the primary locking position of the locking claw to the connecting part is shifted by the male connector housing, so that the fitting detection member becomes possible to move from the temporary locking position to the primary locking position with the female connector housing.

It is possible to detect whether the male connector housing and the female connector housing are brought into a half-fitting state or a fitting state, depending on whether the fitting detection member is movable or immovable.

SUMMARY

In the conventional connector, when the first housing and the second housing are fitted to each other, the first fitting part of the first housing is accommodated in the second fitting part of the second housing, while the fitting detection member is positioned on the outer circumference of the second housing.

The fitting detection member positioned on the outermost side is provided with the locking part for holding the fitting detection member at the temporary locking position and the primary locking position to the second housing.

For this reason, the locking part is easily subjected to an external force due to its interference with peripheral members or the like. Thus, the primary locking position of the fitting detection member to the second housing may change irrespective of the fitted state of the first housing and the second housing, thereby raising the possibility that the fitting state cannot be detected accurately.

It is an object of the present application to provide a connector which is capable of suppressing influence of a fitting detection member on a locking part and which allows detection of fitting state with the fitting detection member to be accomplished stably.

A connector according to an aspect of the present application includes: a first housing having a first fitting part; a second housing having a second fitting part configured so as to be fittable to the first fitting part; a fitting detection member assembled to an outer circumference of the second housing so as to be movable between a temporary locking position and a primary locking position; an engaged part provided on the second fitting part; and an engaging part provided on the fitting detection member so as to be abuttable on the first fitting part, the engaging part being engaged to the engaged part to hold the fitting detection member at the temporary locking position and the primary locking position to the second housing. The second fitting part and the engaging part are accommodated in the first fitting part.

Since the second fitting part and the engaging part are accommodated in the first fitting part, the engaging part for holding the fitting detection member at the temporary locking position and the primary locking position to the second housing is not exposed to the outside, so that it is possible to prevent the engaging part from being subjected to an external force due to its interference with peripheral members or the like.

Therefore, in such a connector, it is possible to suppress the influence of the fitting detection member on the engaging part, thereby allowing the detection of the fitting state with the fitting detection member to be performed stably.

In a modification, the second fitting part may be provided with a contracted part which is formed lower than an outer circumferential surface of the second fitting part; the fitting detection member may be provided with a detective fitting part which is arranged in the contracted part and fittable to an interior side of the first fitting part; and an outer circumferential surface of the second fitting part and the outer circumferential surface of the detective fitting part may be formed flush with each other.

Since the outer circumferential surface of the second fitting part and the outer circumferential surface of the detective fitting part are formed flush with each other, the interior of the first fitting part can be miniaturized by reducing the swelling of the outer circumferential surfaces of the second fitting part accommodated in the first fitting part and the detective fitting part, thereby allowing the overall size of the connector to be miniaturized.

Additionally, the fitting detection member may be assembled to the second housing so as to be movable in a same direction as a fitting direction of the first housing and the second housing; the second fitting part and the detective fitting part may be provided, on their respective opposite surfaces in a moving direction of the fitting detection member, with an engagement projection extending in the moving direction and an engagement hole which is engageable with the engagement projection, respectively; and the engagement projection may have its tip side engaged with the engagement hole at the temporary locking position of the fitting detection member to the second housing.

Since the tip side of the engagement projection is engaged with the engagement hole at the temporary locking position of the fitting detection member to the second housing, it is possible to accomplish the movement of the engagement detection member from the temporary locking position to the primary locking position to the second housing stably.

Additionally, it is possible to insert the second housing into the first fitting part of the first housing smoothly.

Further, the detective fitting part may be formed into a substantial U-shape; and one of the engagement projection and the engagement hole, which is provided in the second fitting part, may be adapted so as to cover at least a part of the outer circumferential surface of the other one of the engagement projection and the engagement hole, which is provided in the detective fitting part.

As one of the engagement projection and the engagement hole, which is provided in the second fitting part covers at least a part of the outer circumferential surface of the other one of the engagement projection and the engagement hole, which is provided in the detective fitting part, it is possible to restrict the movement of the other one provided in the detective fitting part to the outside by the one provided in second fitting part positioned outside the detective fitting part, thereby preventing the U-shaped detective fitting portion from being opened.

Still further, at least one side of the fitting detection member may be formed into a substantial U-shape; and the connector is provided, between the second housing and a substantially U-shaped free end side of the fitting detection member, with opening preventive parts which are engaged in a substantially U-shaped opening direction of the fitting detection member.

Since the opening preventive parts engaged in a substantially U-shaped opening direction of the fitting detection member are provided between the second housing and the substantially U-shaped free end side of the fitting detection member, it is possible to prevent the fitting detection member from being opened, thereby allowing the fitting detection member to be held in the second housing stably.

Further, the fitting detection member may be provided with a confirmation hole penetrating in a movement direction of the fitting detection member to the second housing; and the second housing may be provided with a confirmation projection which is inserted into the confirmation hole at the primary locking position of the fitting detection member to the second housing.

Since the second housing is provided with the confirmation projection to be inserted into the confirmation hole at the primary locking position of the fitting detection member to the second housing, it is possible to detect the fitting state between the first housing and the second housing by visually confirming the presence/absence of the confirmation projection inserted into the confirmation hole.

With the connector according to the aspect of the present application, it is possible to suppress the influence of the fitting detection member on the engaging part and accomplish the detection of the fitting state with the fitting detection member stably.

DESCRIPTION OF EMBODIMENTS

Figure 1:
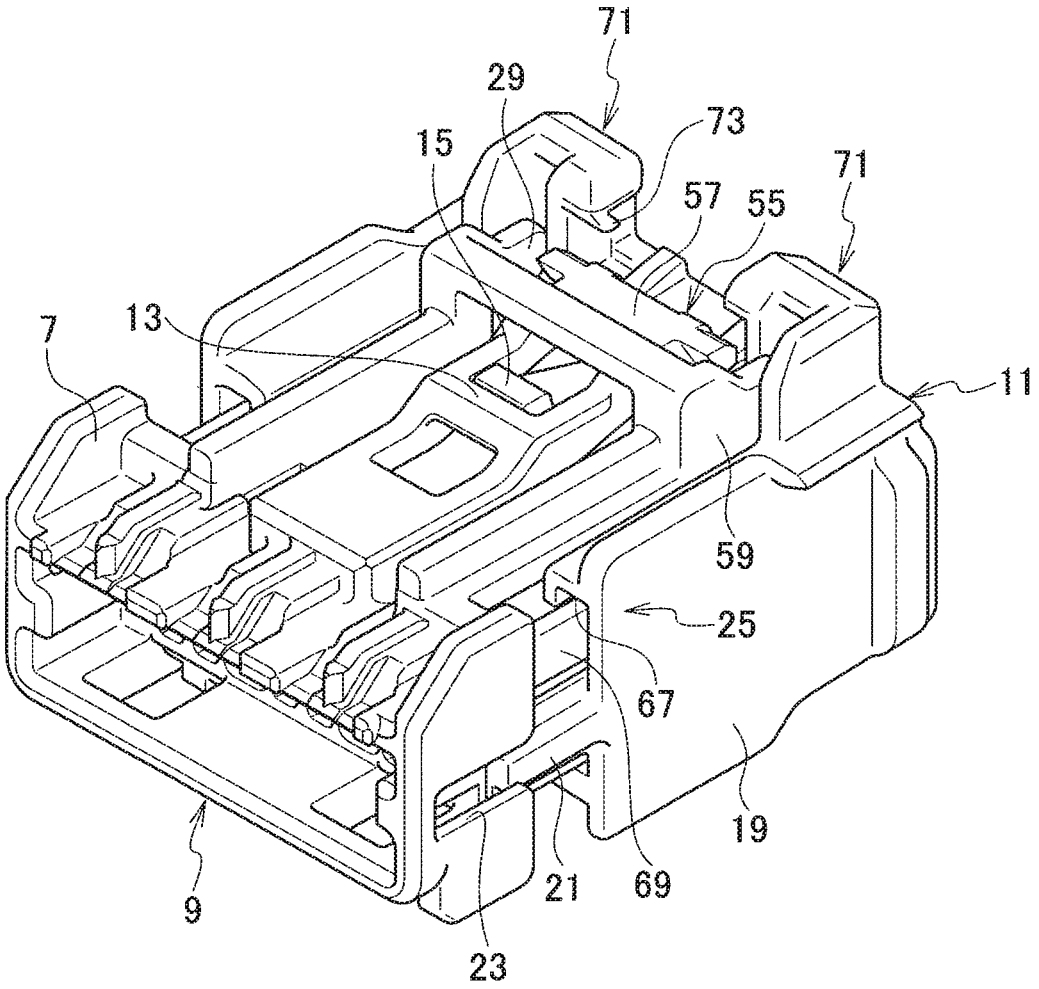
FIG. 1 is a perspective view illustrating a condition that a fitting detection member is assembled to a second housing of a connector according to an embodiment.
Figure 2:
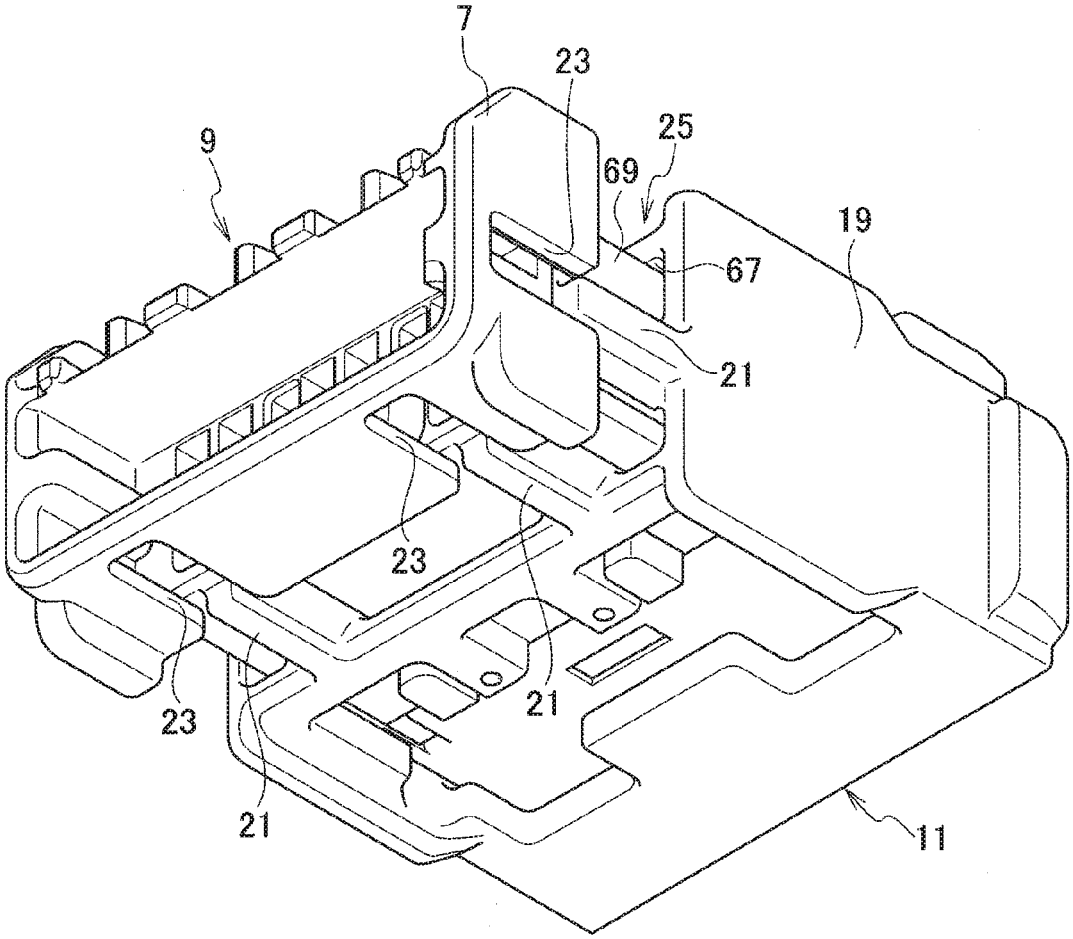
FIG. 2 is a perspective view illustrating the condition that the fitting detection member is assembled to the second housing of the connector according to the embodiment as viewed from a direction different from FIG. 1.
Figure 3:
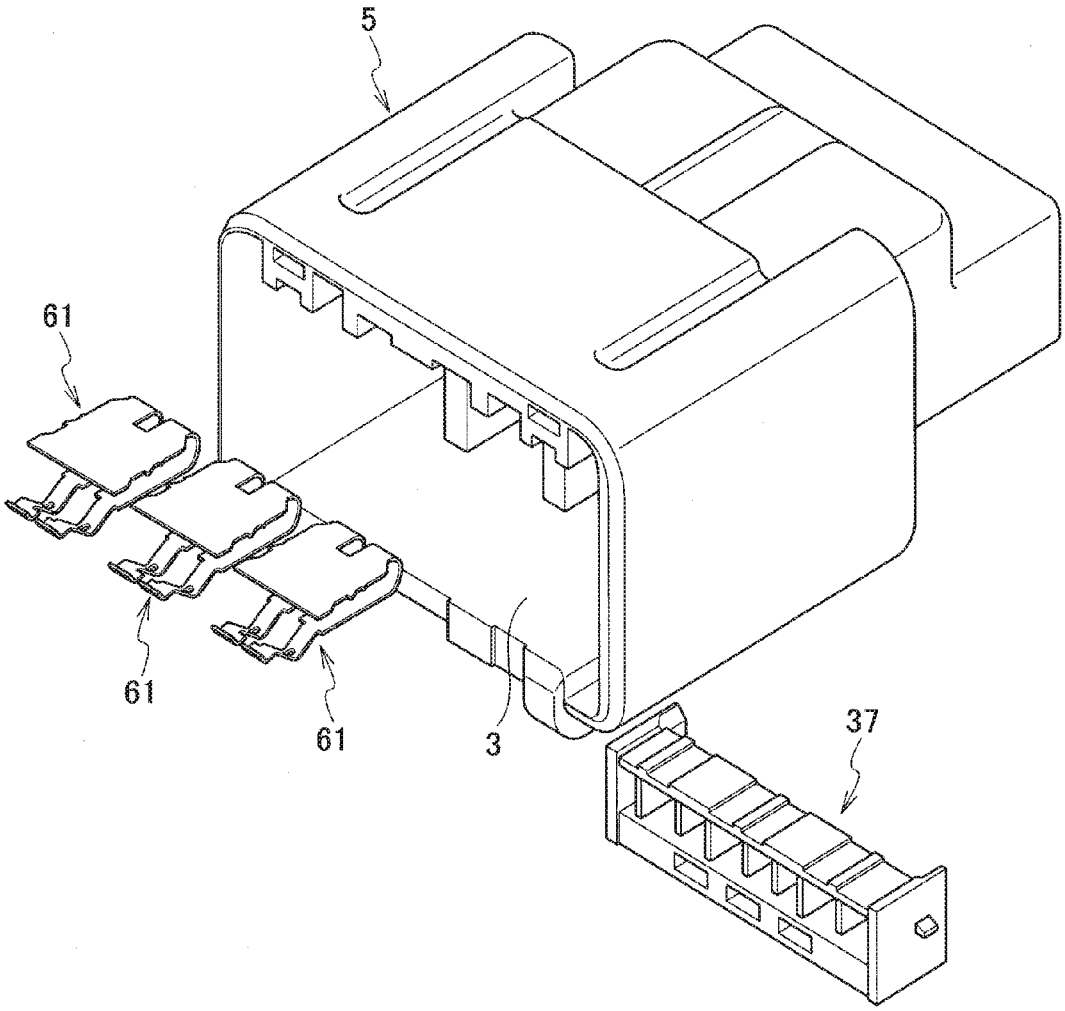
FIG. 3 is an exploded perspective view of a first housing of the connector according to the embodiment.
Figure 4:
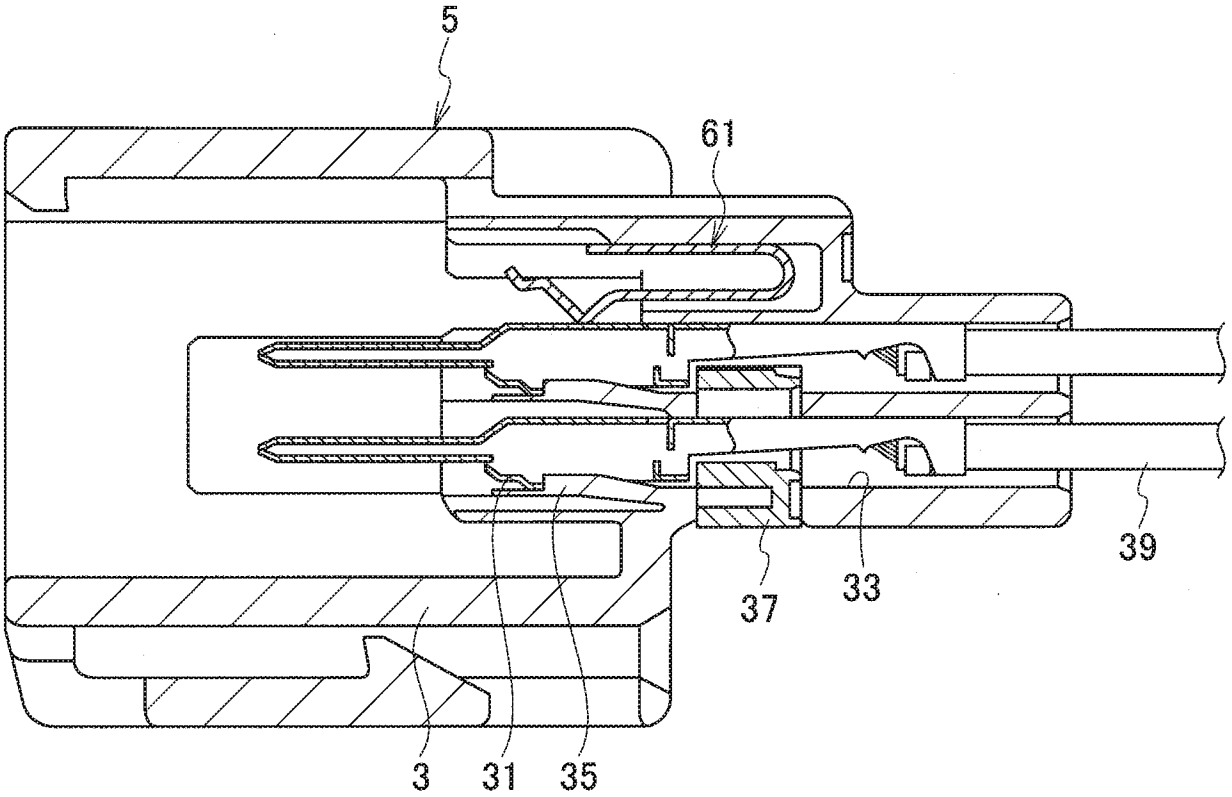
FIG. 4 is a cross-sectional view of the first housing of the connector according to the embodiment.
Figure 5:
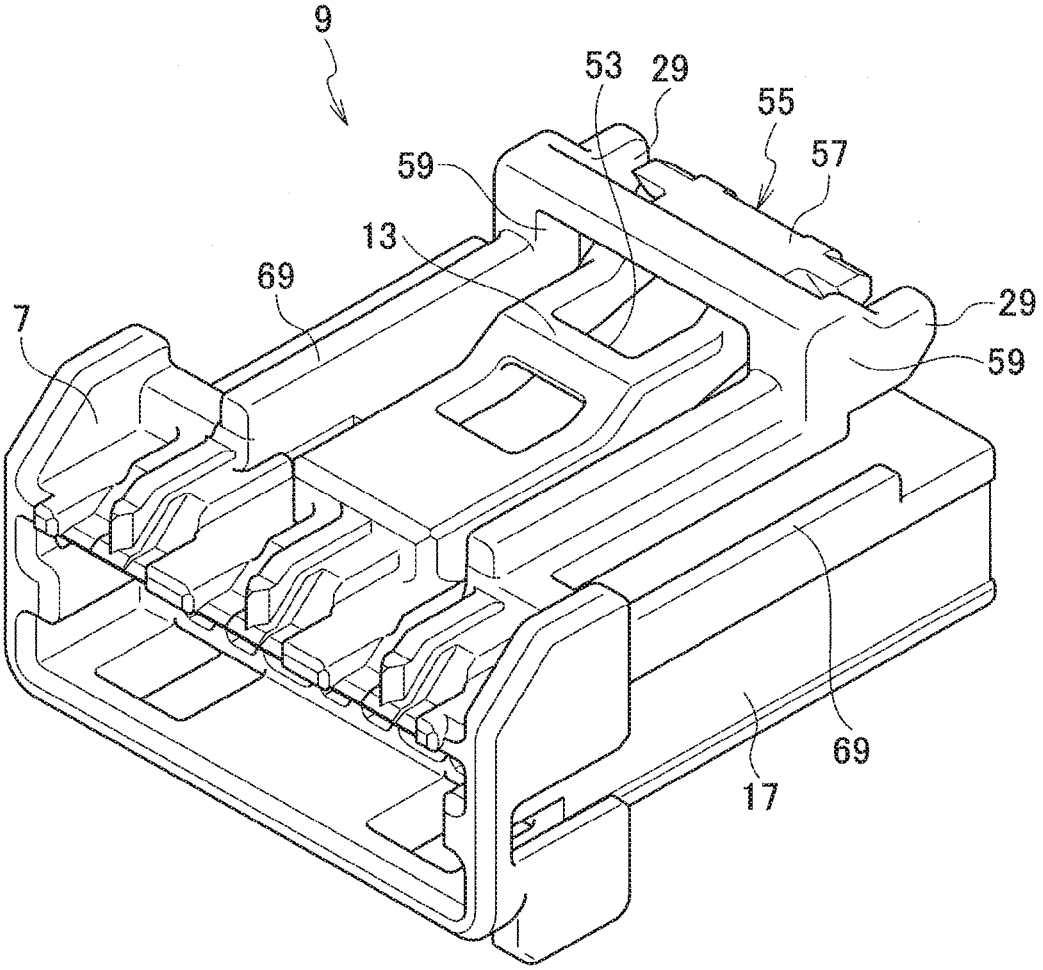
FIG. 5 is a perspective view of the second housing of the connector according to the embodiment.
Figure 6:
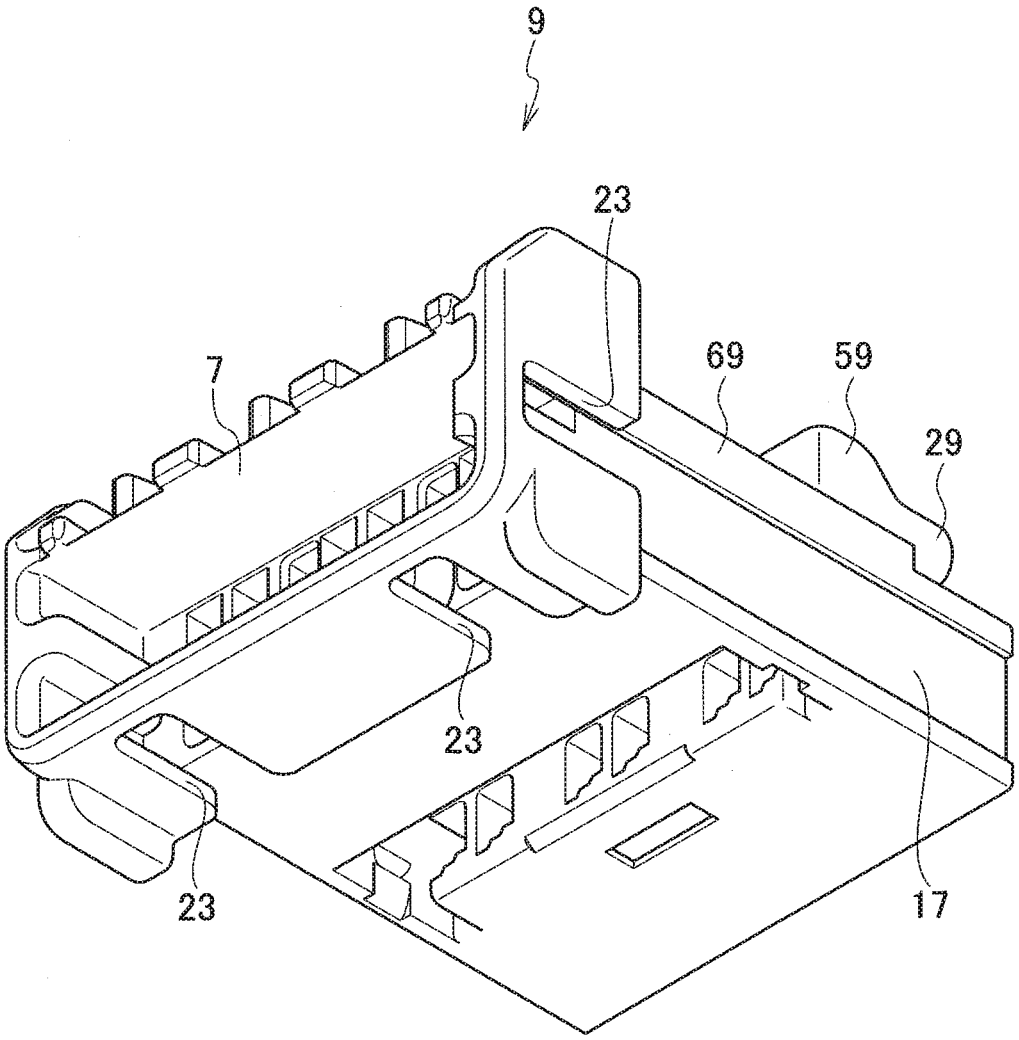
FIG. 6 is a perspective view of the second housing of the connector according to the embodiment as viewed from a direction different from FIG. 5.
Figure 7:
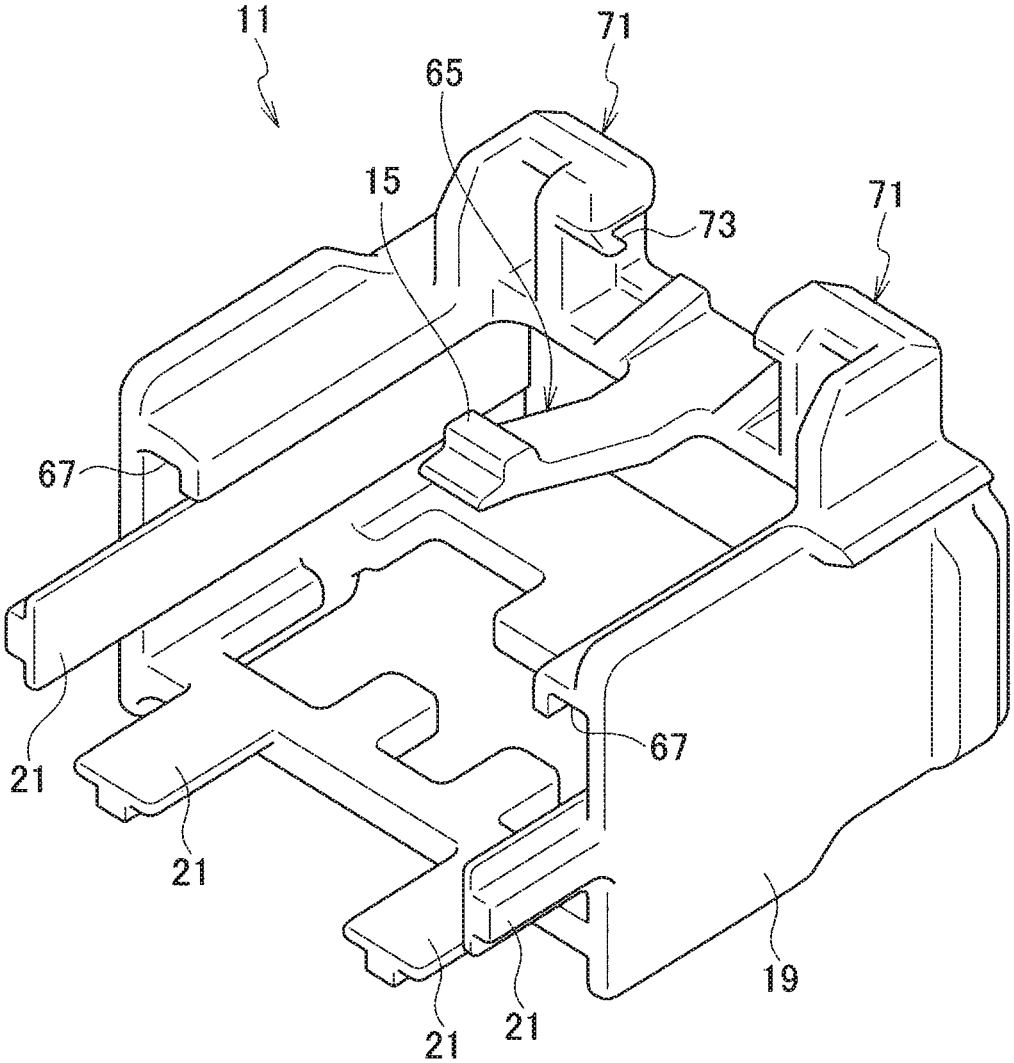
FIG. 7 is a perspective view of the fitting detection member of the connector according to the embodiment.
Figure 8:
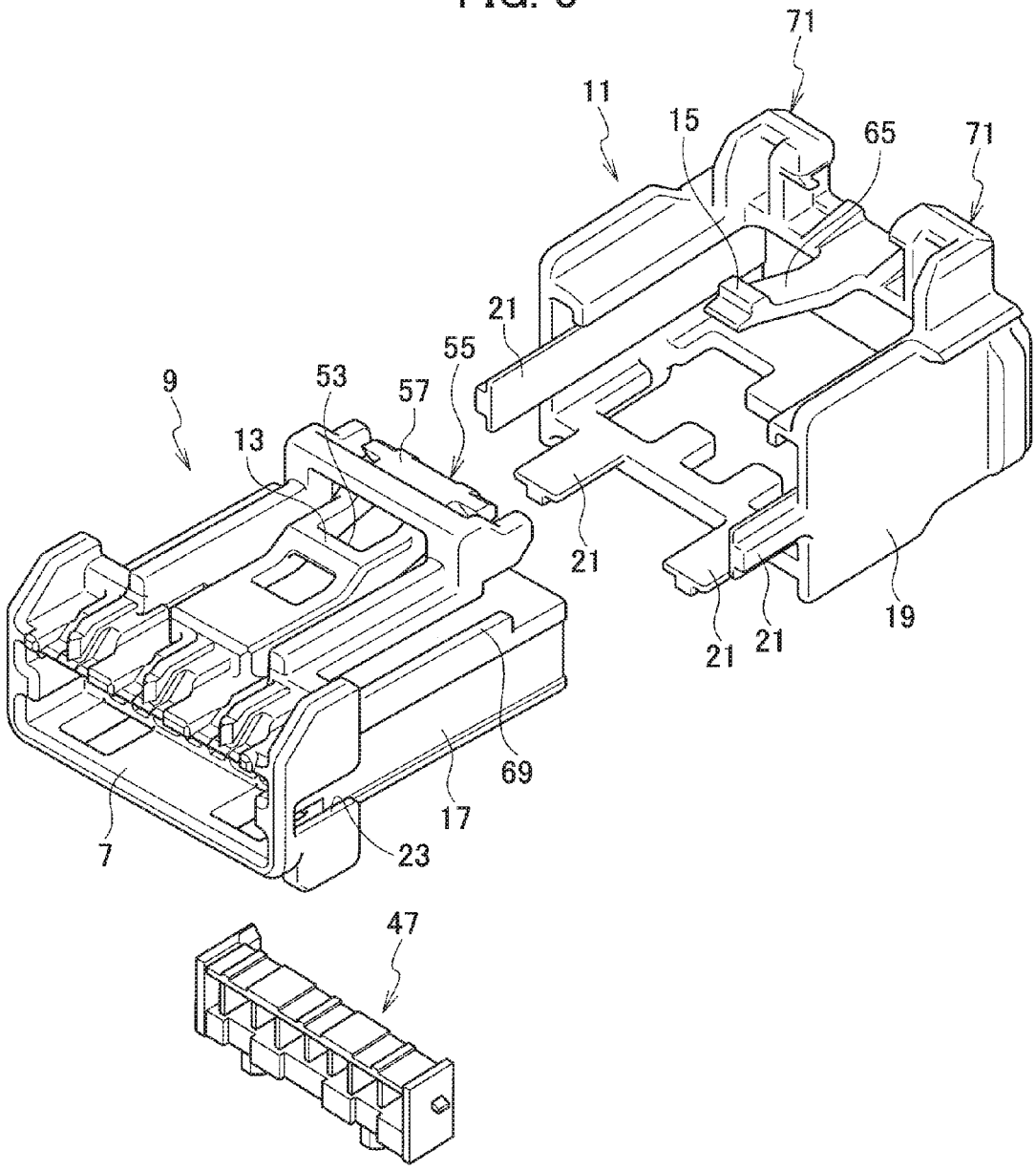
FIG. 8 is an exploded perspective view illustrating a condition before assembling the fitting detection member to the second housing of the connector according to the embodiment.
Figure 9:
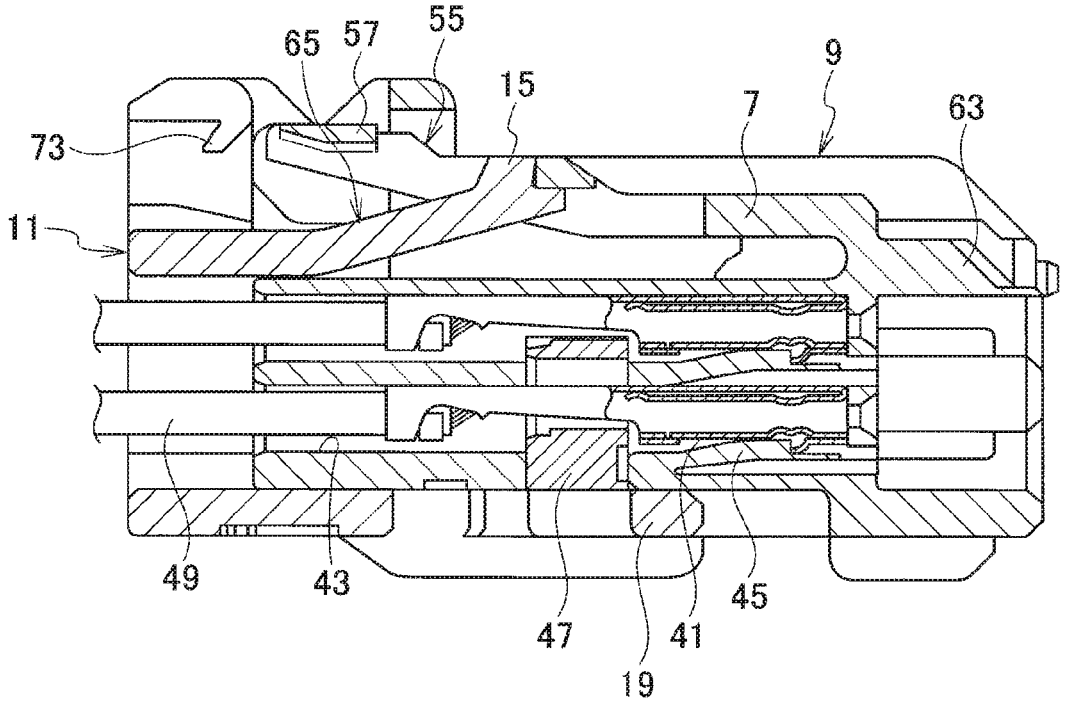
FIG. 9 is a cross-sectional view illustrating the condition that the fitting detection member is assembled to the second housing of the connector according to the embodiment.
Figure 10:
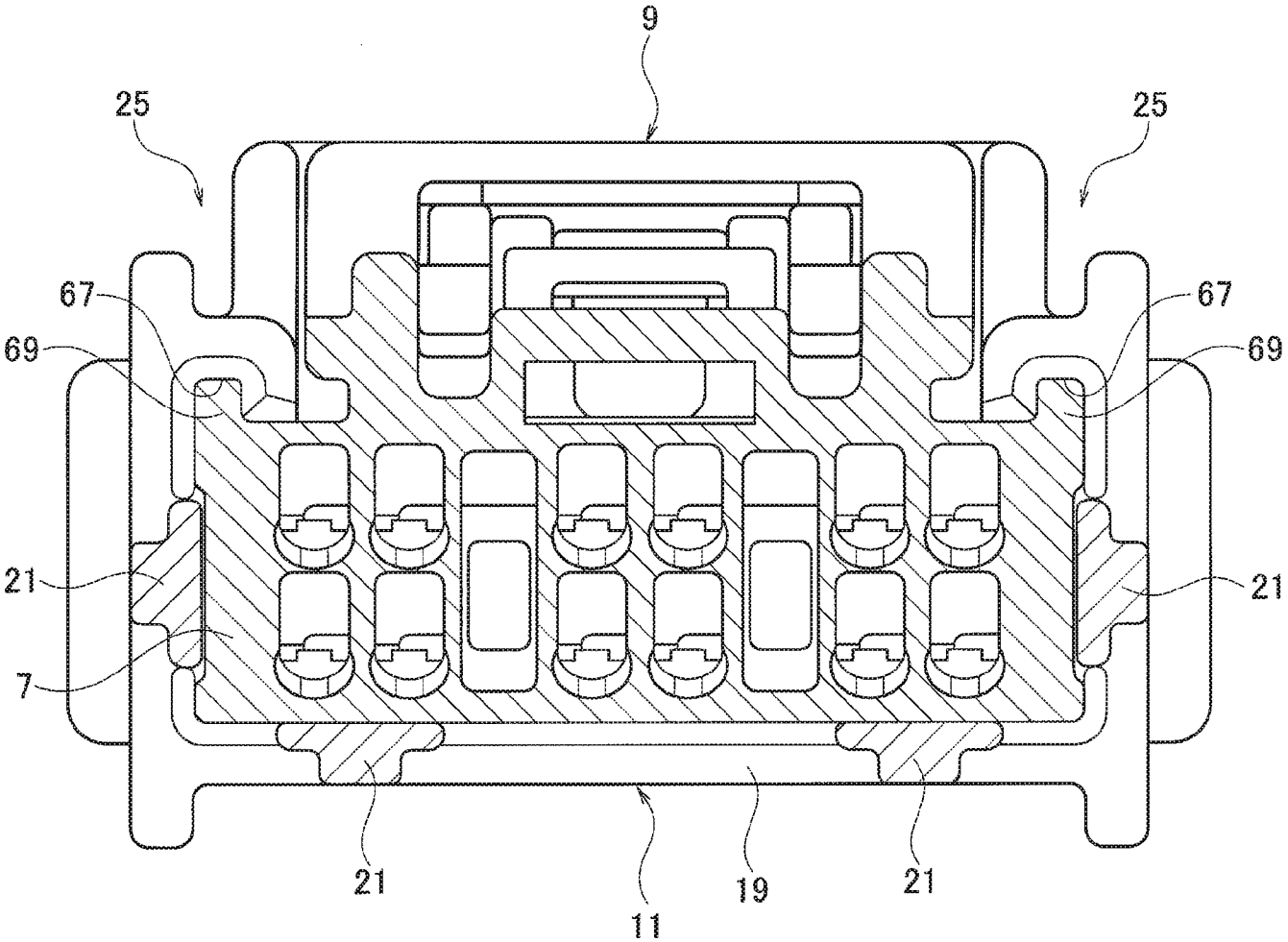
FIG. 10 is a cross-sectional view taken along a section different from that of FIG. 9, illustrating the condition that the fitting detection member is assembled to the second housing of the connector according to the embodiment.
Figure 11:
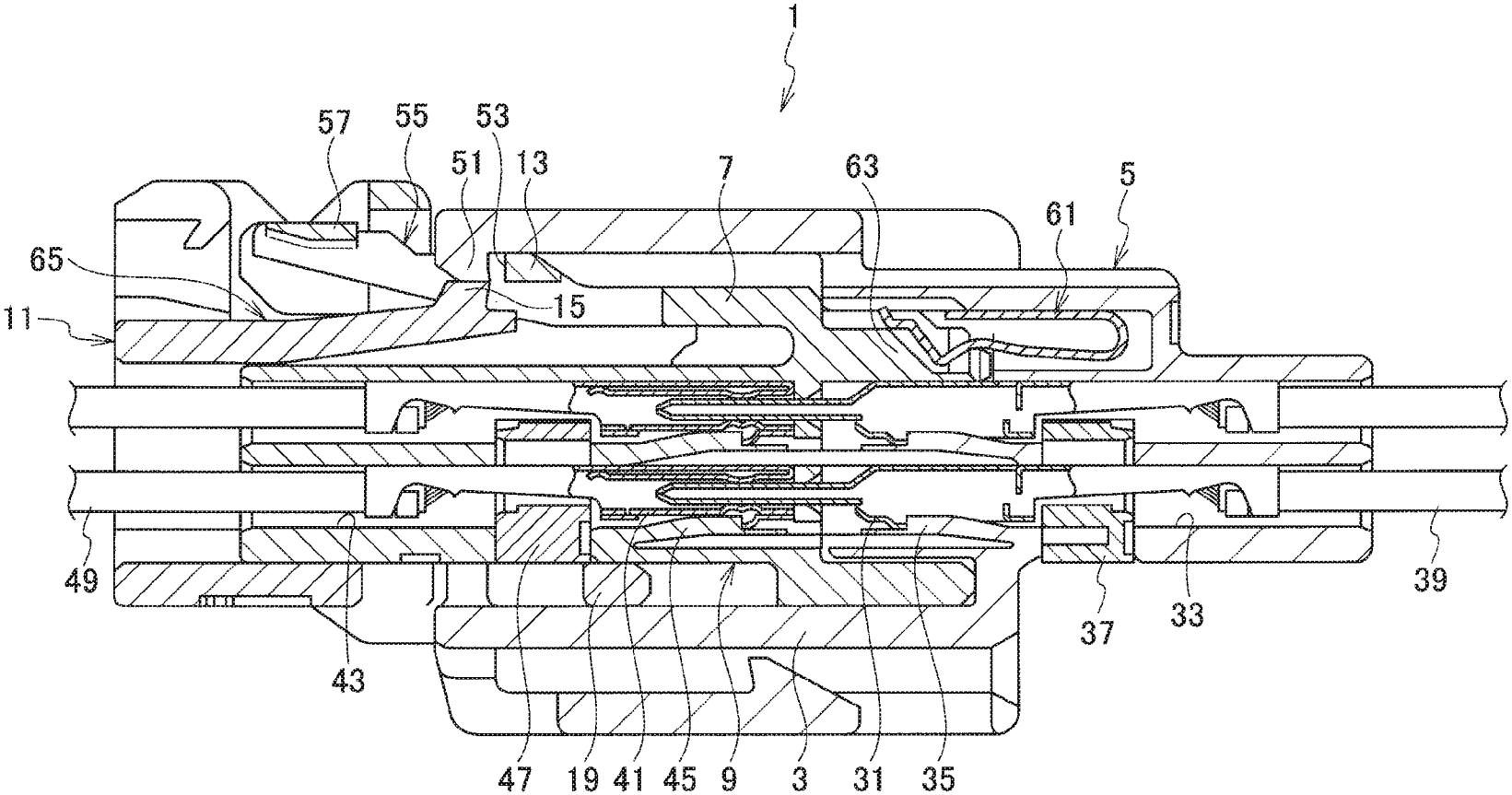
FIG. 11 is a cross-sectional view illustrating a condition that the first housing and the second housing of the connector according to the embodiment are fitted to each other and the fitting detection member is located at a temporary locking position.
Figure 12:
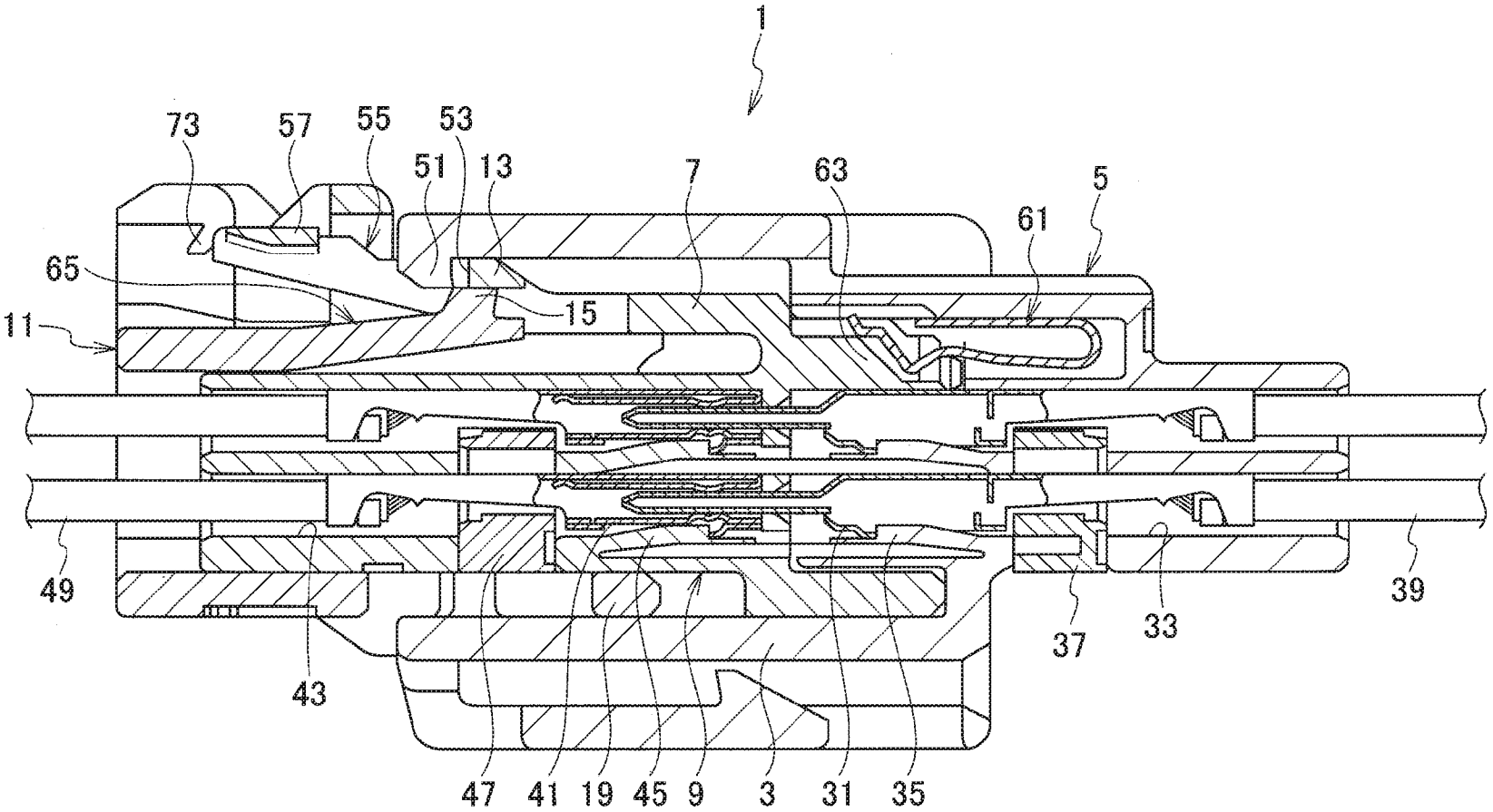
FIG. 12 is a cross-sectional view illustrating a condition that the first housing and the second housing of the connector according to the embodiment are fitted to each other and when moving the fitting detection member from the temporary locking position to a primary locking position.
Figure 13:
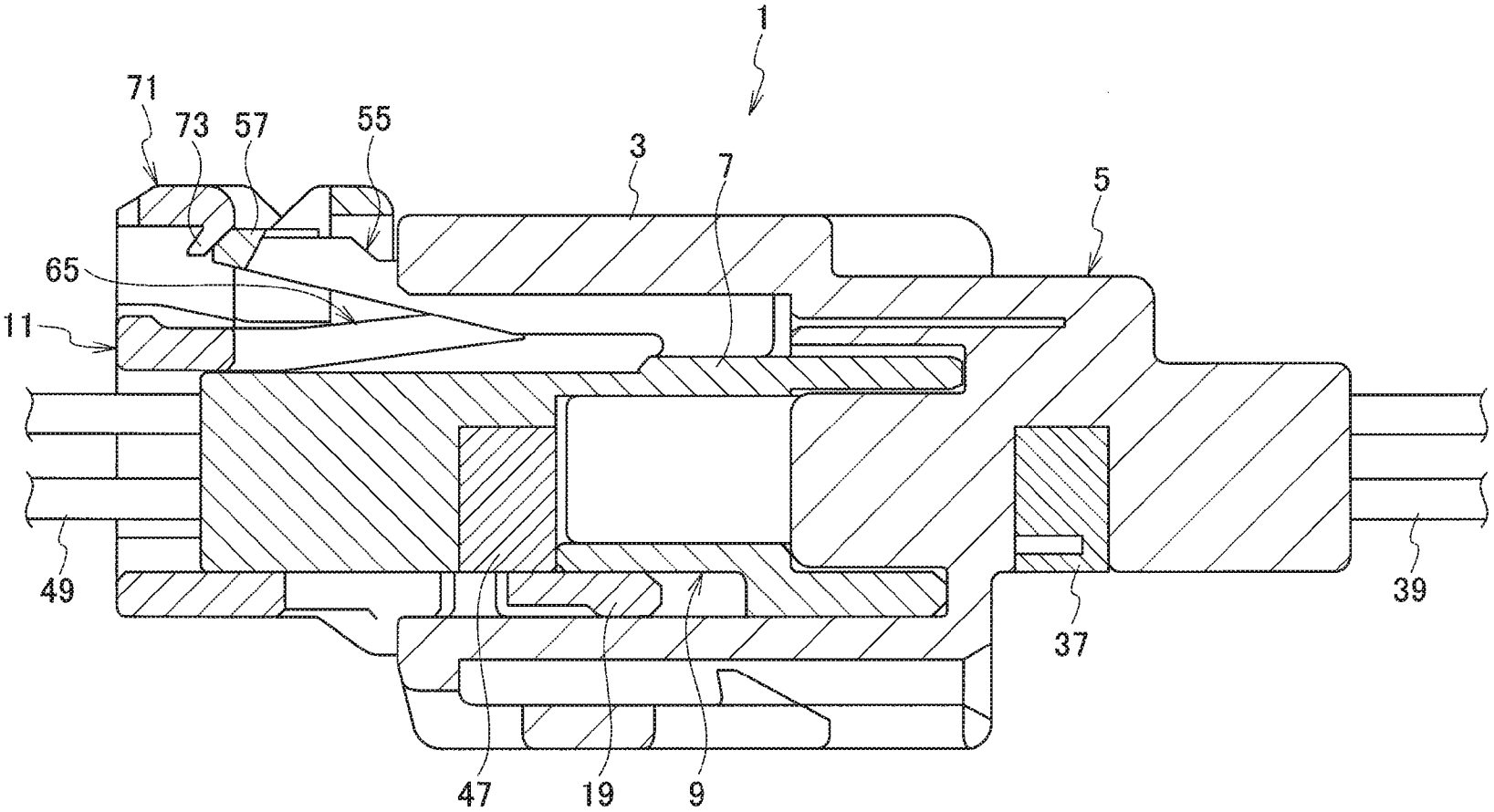
FIG. 13 is a cross-sectional view taken along a section different from that of FIG. 12, illustrating the condition that the first housing and the second housing of the connector according to the embodiment are fitted to each other and when moving the fitting detection member from the temporary locking position to the primary locking position.
Figure 14:
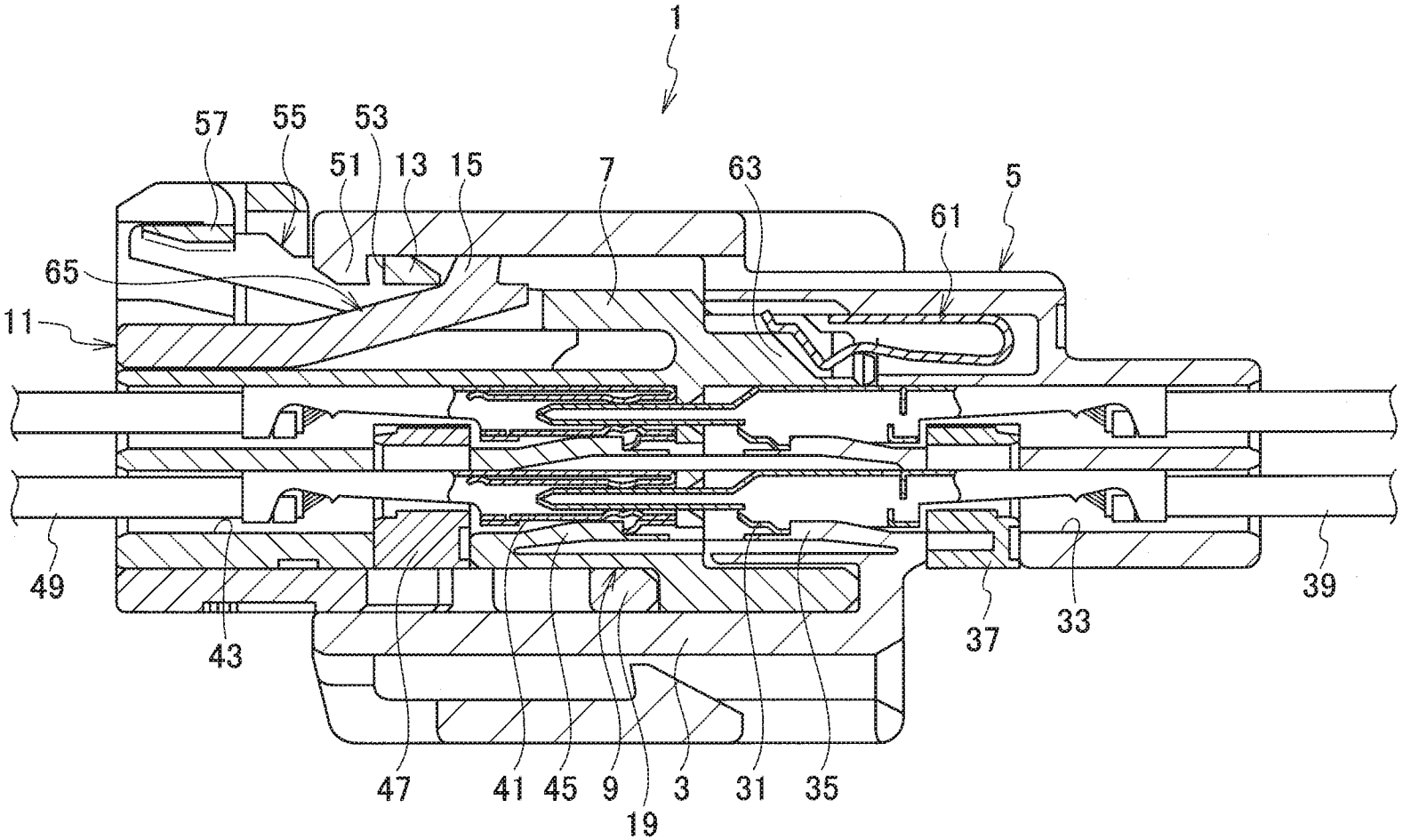
FIG. 14 is a cross-sectional view illustrating a condition that the first housing and the second housing of the connector according to the embodiment are fitted to each other and the fitting detection member is located at the primary locking position.
Figure 15:
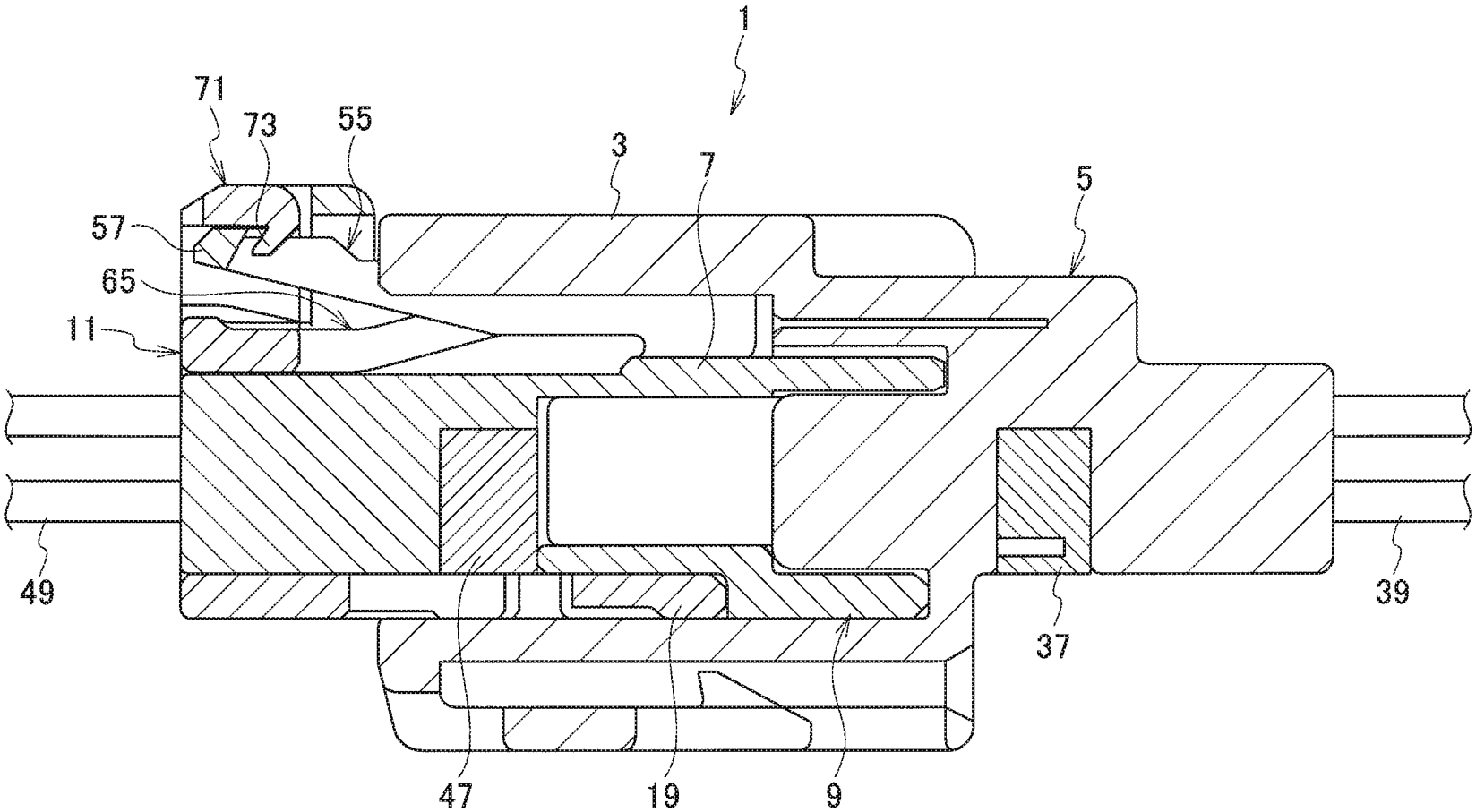
FIG. 15 is a cross-sectional view taken along a section different from that of FIG. 14, illustrating the condition that the first housing and the second housing of the connector according to the embodiment are fitted to each other and the fitting detection member is located at the primary locking position.
Figure 16:
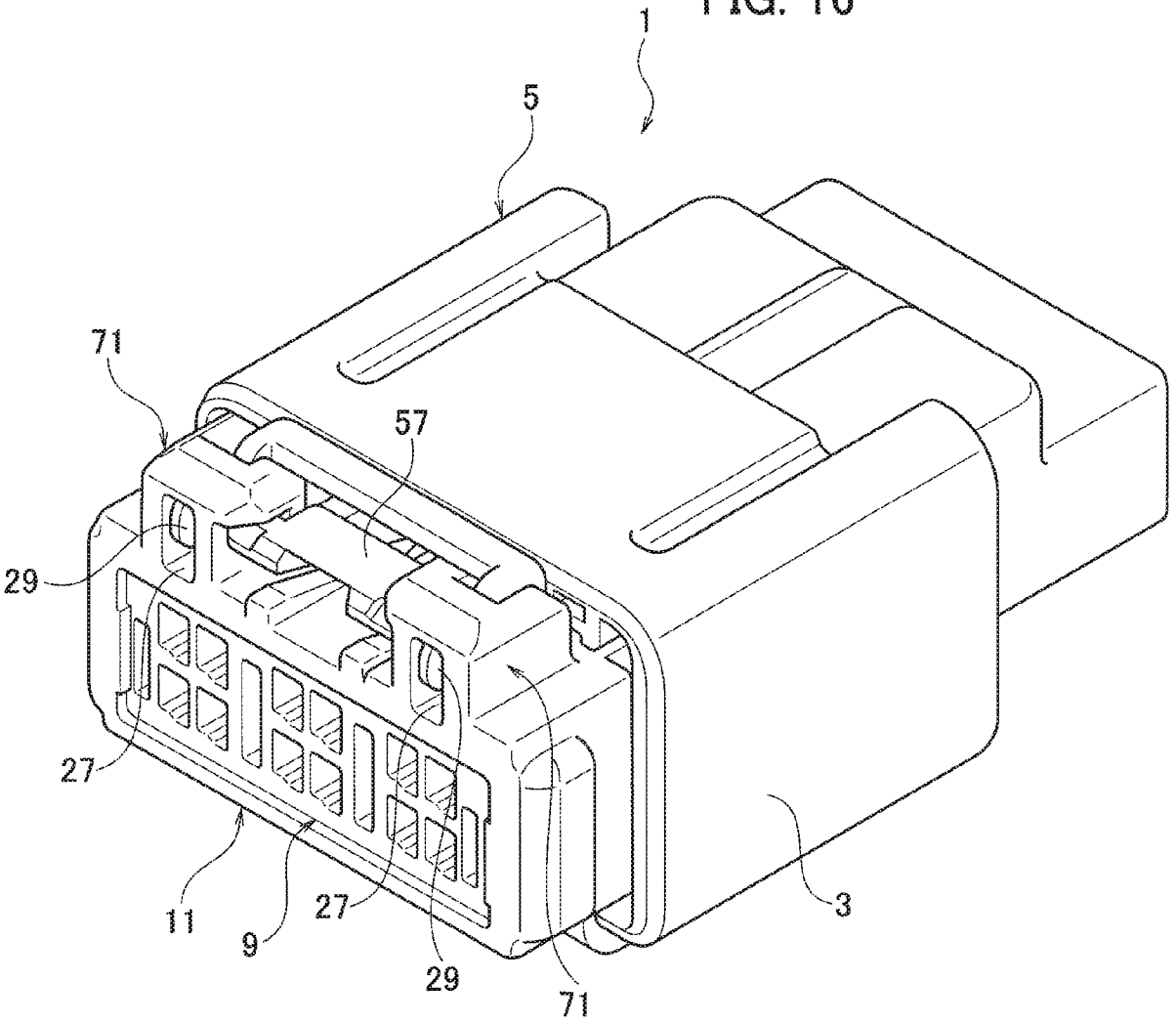
FIG. 16 is a perspective view illustrating the condition that the fitting detection member of the connector according to the embodiment is located at the primary locking position.
Figure 17:
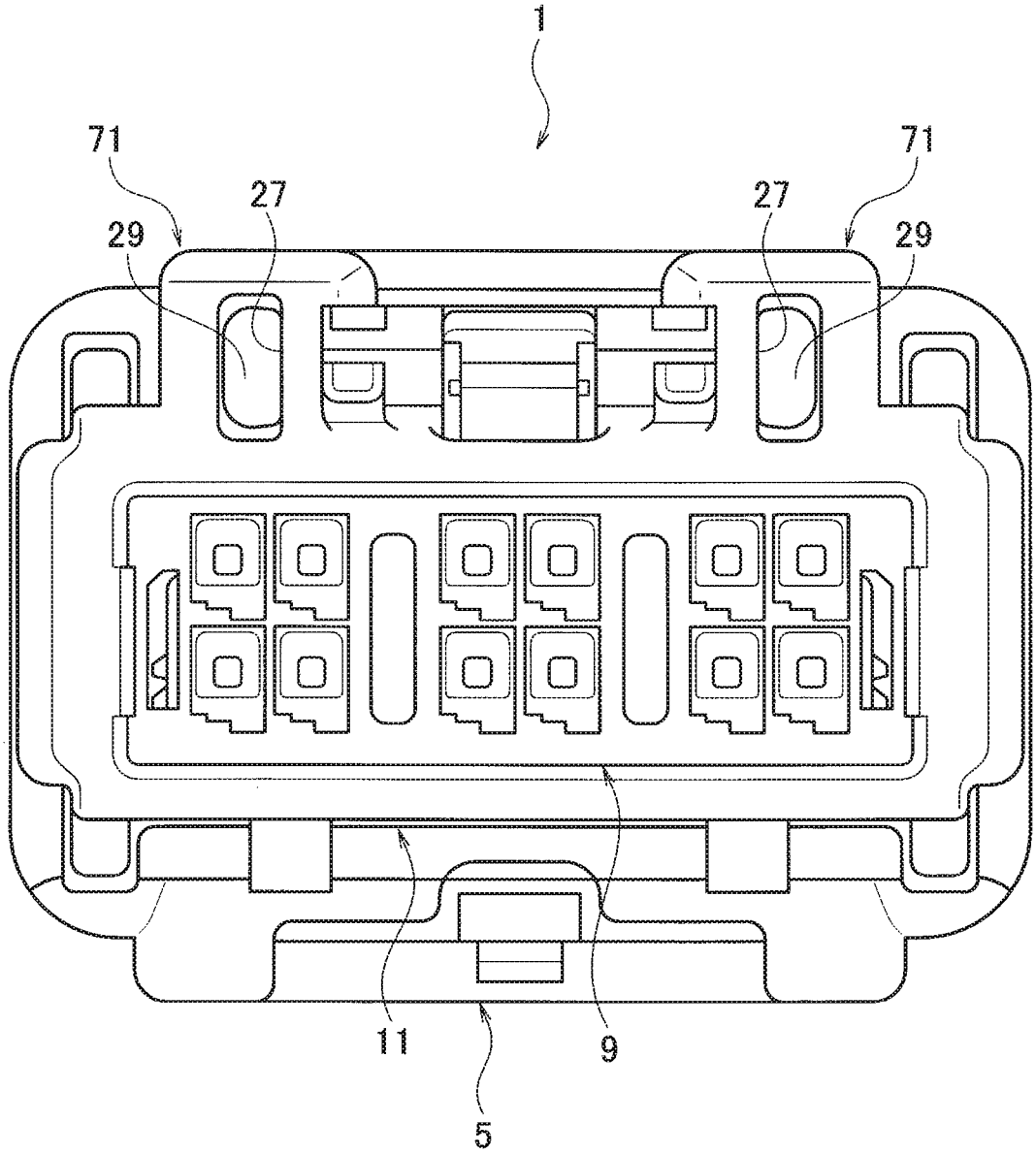
FIG. 17 is a front view w illustrating the condition that the fitting detection member of the connector according to the embodiment is located at the primary locking position.

A connector according to an embodiment will be described with reference to FIGS. 1 to 17.

The connector 1 according to the embodiment includes a first housing 5 having a first fitting part 3, a second housing 9 having a second fitting part 7 configured to be fittable to the first fitting part 3, and a fitting detection member 11 assembled to an outer circumference of the second housing 9 so as to be movable between a temporary locking position and a primary locking position.

The fitting detection member 11 is provided with an engaging part 15 which is locked to an engaged part 13 of the second fitting part 7 to hold the fitting detection member 11 at the temporary locking position and the primary locking position to the second housing 9. The engaging part 15 is arranged so as to be abuttable on the first fitting part 3.

The second fitting part 7 and the engaging part 15 are accommodated in the first fitting part 3.

The second fitting part 7 is provided with a contracted part 17 which is formed lower than an outer circumferential surface. The fitting detection member 11 is provided with a detective fitting part 19 which is arranged in the contracted part 17 and fittable to an interior side of the first fitting part 3.

The outer circumferential surface of the second fitting part 7 and the outer circumferential surface of the detective fitting part 19 are formed flush with each other.

The fitting detection member 11 is assembled the second housing 9 so as to be movable in the same direction as the fitting direction of the first housing 5 and the second housing 9.

On respective opposite surfaces of the detective fitting part 19 and the second fitting part 7 in the moving direction of the fitting detection member 11, there are formed engagement projections 21 each extending in the moving direction and engagement holes 23 which are engageable with the engagement projections 21.

The tip side of each of the engagement projections 21 is engaged with corresponding engagement hole 23 at the temporary locking position of the fitting detection member 11 to the second housing 9.

The detective fitting part 19 is formed into a V-shape. Each of the engagement holes 23 of the second fitting part 7 is adapted so as to cover at least a part of an outer circumferential surface of corresponding engagement projection 21 of the detective fitting part 19.

Between the second housing 9 and the U-shaped free end side of the fitting detection member 11, there are provided opening preventive parts 25 which are engaged in a U-shaped opening direction of the fitting detection member 11.

The fitting detection member 11 is provided with confirmation holes 27 penetrating in the movement direction to the second housing 9. The second housing 9 is provided with confirmation projections 29 which are inserted into the confirmation holes 27 at the primary locking position of the fitting detection member 11 to the second housing 9.

The first housing 5 is made of insulating material such as synthetic resin. The first housing 5 is provided with the first fitting part 3 which is opened to one side of the first housing 5 and in which the second fitting part 7 of the second housing 9 can be fitted.

The first fitting part 3 is provided, on its bottom side, with a plurality of first terminal accommodating chambers 33 for accommodating first terminals 31.

The plurality of first terminal accommodating chambers 33 are opened on the other side of the first housing 5. Inside each of the first terminal accommodating chambers 33, there is bendably arranged a first locking lance 35 for locking corresponding first terminal 31.

An opening is opened to the bottom surface of the first housing 5 and communicates with the plurality of first terminal accommodating chambers 33. By inserting a first spacer 37 into the opening, the plurality of first terminals 31 are doubly locked in the first terminal accommodating chambers 33.

The plurality of first terminals 31 are respectively accommodated in the plurality of first terminal accommodating chambers 33 through an opening formed on the other side of the first housing 5.

Each of the first terminals 31 is composed of a male terminal having a tab-shaped connecting part. The first terminals 31 are electrically connected to terminal parts of a plurality of electric wires 39 which are connected to, for example, an air-bag circuit for controlling the operation of an air bag.

The plurality of first terminals 31 are connected to a plurality of second terminals 41 accommodated in the second housing 9 since the second fitting part 7 of the second housing 9 is fitted to the first fitting part 3 of the first housing 5.

The second housing 9 is made of insulating material such as a synthetic resin. The second housing 9 is provided, on its one side, with the second fitting part 7 which is fittable in the first fitting part 3 of the first housing 5, which has the opening formed to allow an insertion of the tab-shaped connecting parts of the first terminals 31.

Inside the second fitting part 7, there are provided a plurality of second terminal accommodating chambers 43 for accommodating the second terminals 41.

The plurality of second terminal accommodating chambers 43 are opened on the other side of the second housing 9. Inside each of the second terminal accommodating chambers 43, there is bendably provided a second locking lance 45 for locking the second terminal 41.

An opening is opened to the bottom surface of the second housing 9 and communicates with the plurality of second terminal accommodating chambers 43. By inserting a second spacer 47 into the opening, the plurality of second terminals 41 are doubly locked in the second terminal accommodating chambers 43.

The plurality of second terminals 41 are respectively accommodated in the plurality of second terminal accommodating chambers 43 through an opening formed on the other side of the second housing 9.

Each of the second terminals 41 is composed of a female terminal having a box-shaped connecting part allowing an insertion of the tab-shaped connecting part of the first terminal 31. The second terminals 41 are electrically connected to terminal parts of a plurality of electric wires 49 which are connected to, for example, a power supply an instrument, or the like.

The plurality of second terminals 41 are electrically connected to the plurality of first terminals 31 accommodated in the first housing 5 since the second fitting part 7 of the second housing 9 is fitted to the first fitting part 3 of the first housing 5.

The fitting state of the first housing 5 and the second housing 9 is held by the engagement of a locking part 51 provided in the first housing 5 with a locked part 53 provided in the second housing 9.

The locking part 51 is arranged at the opening edge of the first fitting part 3 of the first housing 5 to form a projection protruding toward the interior side of the first fitting part 3.

The locked part 53 constitutes an opening provided in the vicinity of the central part of a lock arm 55 which is flexibly arranged on the upper surface of the second housing 9.

During fitting between the first housing 5 and the second housing 9, the locking part 51 abuts on the lock arm 55, causing the lock arm 55 to be deflected downward. Then, when the first housing 5 and the second housing 9 are fitted to each other, the locking part 51 reaches the locked part 53, and then the lock arm 55 restores upward. Thus the locking part 51 is locked to the locked part 53.

With the engagement of the locking part 51 with the locked part 53, the second fitting part 7 of the second housing 9 is prevented from slipping out of the first fitting part 3 of the first housing 5, so that the fitting state between the first housing 5 and the second housing 9 is maintained.

When releasing the fitting of the first housing 5 to the second housing 9, an operating part 57 provided on the free-end side of the lock arm 55 is pushed downward. Consequently, the lock arm 55 is bent downward to release the engagement between the locking part 51 and the locked part 53, thereby allowing the fitting state between the first housing 5 and the second housing 9 to be released.

On both sides of the operating part 57 of the lock arm 55, a pair of protection walls 59 are formed so as to protrude from the upper surface of the second housing 9 and protect the operating part 57.

By protecting the operating part 57 with the protection walls 59, it is possible to prevent an interference between the operating part 57 and its peripheral members and therefore, misoperation of the operating part 57 due to the interference with the peripheral members can be prevented.

In the first housing 5, there are accommodated short-circuit terminals 61 which are brought into contact with the plurality of first terminals 31 to electrically connect them with each other under condition that the first housing 5 and the second housing 9 are not fitted to each other.

By connecting the plurality of first terminals 31 with each other through the short-circuit terminals 61, it is possible to prevent potential differences from being generated among the first terminals 31 due to static electricity under condition that the fitting state between the first housing 5 and the second housing 9 is released by e.g. maintenance or the like and therefore, an erroneous explosion of an air bag can be prevented.

The mutual connection among the first terminals 31 through the short-circuit terminals 61 is released since respective contact pieces of the short-circuit terminals 61 in contact with the first terminals 31 are displaced by a push-up part 63 of the second housing 9 when the first housing 5 and the second housing 9 are fitted to each other.

Such a fitting state of the first housing 5 and the second housing 9 can be detected by the position of the fitting detection member 11 assembled to the outer circumference of the second housing 9.

The fitting detection member 11 is made of insulating material such as synthetic resin. The fitting detection member 11 is assembled to the outer circumference of the second housing 9 so as to be movable in the same direction as the fitting direction of the first housing 5 and the second housing 9. The engaging part 15 is provided on one side of the fitting detection member 11. The detective fitting part. 19 is provided on the other side of the fitting detection member 11.

The engaging part 15 is provided on the free end side of a detection arm 65 bendably provided on one side of the fitting detection member 11.

The engaging part 15 is engaged to the engaged part 13 constituting the locked part 53 provided on the lock aim 55 of the second housing 9. The engaging part 15 is arranged so as to be abuttable on the locking part 51 of the first housing 5 when the first housing 5 and the second housing 9 are fitted to each other.

When the first housing 5 and the second housing 9 are not fitted to each other or when they are brought into in a half-fitting state, the engaging part 15 is engaged with the locked part 53 side of the engaged part 13 to restrict the movement of the fitting detection member 11 from the temporary locking position to the primary locking position, thereby holding the temporary locking position of the fitting detection member 11 to the second housing 9.

If the first housing 5 and the second housing 9 are fitted to each other from the above state, the locking part 51 abuts on the engaging part 15, so that the detection aim 65 is deflected downward and consequently, the engagement between the engaging part 15 and the engaged part 13 is released.

Under the condition that the engagement between the engaging part 15 and the engaged part 13 is released, the fitting detection member 11 can be moved from the temporary locking position to the primary locking position to the second housing 9 and therefore, it is possible to detect that the housing 5 and the second housing 9 have been fitted to each other.

Under the condition that the fitting detection member 11 is positioned at the primary locking position, the detection arm 65 is restored upward, so that the engaging part 15 is engaged with the engaged part 13 side opposite to the locked part 53 to hold the fitting detection member 11 at the primary locking position to the second housing 9.

Depending on whether or not the position of the fitting detection member 11 to the second housing 9 is shifted from the temporary locking position to the primary locking position, it is possible to detect whether or not the first housing 5 and the second housing 9 have been fitted to each other, thereby allowing the fitting state of the first housing 5 and the second housing 9 to be detected.

The engaging part 15 for controlling the movement of the fitting detection member 11 to the second housing 9 is accommodated in the first fitting part 3 of the first housing 5.

By accommodating the engaging part 15 in the first fitting part 3, the first fitting part 3 is positioned outside the engaging part 15. Thus, as there is no possibility that the engaging part 15 interferes with the peripheral members, it is possible to prevent the engaging part 15 from being subjected to an external force.

Therefore, it is possible to accurately control the movement of the fitting detection member 11 in accordance with the fitting state of the first housing 5 and the second housing 9, thereby allowing the detection of the fitting state with the fitting detection member 11 to be accomplished stably.

The detective fitting part 19 is provided on the other side of the fitting detection member 11 and is formed into a U-shape with an opened upper surface. The detective fitting part 19 is disposed in the contracted part 17 which is formed to be lower than the outermost circumferential surface of the second fitting part 7 of the second housing 9.

The detective fitting part 19 is movably arranged in the contracted part 17. When the first housing 5 and the second housing 9 are fitted to each other, the detective fitting part 19 is fitted to the interior side of the first fitting part 3 of the first housing 5 and also accommodated in the first fitting part 3.

The outer circumferential surface of the detective fitting part 19 is formed flush with the outermost circumferential surface of the second fitting part 7.

By forming the outer circumferential surface of the detective fitting part 19 flush with the outer circumferential surface of the second fitting part 7, the outer circumferential surface of the detective fitting part 19 does not protrude from the outer circumferential surface of the second fitting part 7. As a result, it is possible to miniaturize the inside of the first fitting part 3 in which the detective fitting part 19 is accommodated, thereby allowing the connector 1 to be miniaturized.

The engagement projections 21 and the engagement holes 23 are provided on respective opposite surfaces of the detective fitting part 19 and the second fitting part 7 in the moving direction of the fitting detection member 11.

The engagement projections 21 are formed so as to extend from the surface of the detective fitting part 19, which are opposed to the second fitting part 7, toward the second fitting part 7 in the movement direction. There are the plurality of engagement projections 21 (four in the embodiment) in the circumferential direction of the detective fitting part 19.

Each of the engagement projections 21 is formed with a T-shaped cross section so as to protrude toward the outside of the fitting detection member 11. The T-shape is continuously formed over the moving direction of the fitting detection member 11.

Each of the engagement holes 23 is formed so as to extend from the surface of the second fitting part 7, which is opposed to the detective fitting part 19, toward the second fitting part 7 in the movement direction. Corresponding to the engagement projections 21, there are a plurality of engagement holes 23 (four in the embodiment) in the circumferential direction of the second fitting part 7.

Each of the engagement holes 23 is covered a part of the outer circumferential surface of corresponding engagement projection 21.

Under the condition that the fitting detection member 11 is assembled at the temporary engagement position to the second housing 9, the engagement projections 21 and the engagement holes 23 are brought into a condition where the tip side of each of the engagement projections 21 is inserted into corresponding engagement hole 23.

Here, assume that the engagement projections 21 and the engagement holes 23 are not provided or that the tip side of each of the engagement projections 21 is not inserted into corresponding engagement hole 23 at the temporary locking position of the fitting detection member 11. In such a case, a perfect clearance without any abutment will be produced between the second fitting part 7 and the engagement projections 21 or between the second fitting part 7 and the detective fitting part 19.

If the second housing 9 is attempted to be inserted into the first fitting part 3 of the first housing 5 under such a condition, the tip of each of the engagement projections 21 or the edge of the detective fitting part 19 may collide with the opening edge of the first fitting part 3, thereby raising the possibility that the second housing 9 cannot be smoothly inserted into the first fitting part 3.

From this perspective, by engaging the tip side of each of the engagement projections 21 with corresponding engagement hole 23 at the temporary engagement position of the fitting detection member 11, it is possible to smoothly insert the second housing 9 into the first fitting part 3.

With the engagement between the engagement projections 21 and the engagement holes 23, it is possible to stably move the fitting detection member 11 from the temporary locking position to the primary locking position to the second housing 9.

Since a part of the outer circumferential surface of each of the engagement projections 21 is covered by corresponding engagement hole 23, it is possible to prevent the U-shaped detective fitting part 19 from being opened and also possible to prevent the fitting detection member 11 from being deformed.

As for the shapes of each of the engagement projections 21 and each of the engagement holes 23, for example, each of the engagement projections 21 may be formed with a trapezoid projecting outward, provided that each of the engagement holes 23 is shaped as to cover the trapezoidal inclined surfaces of each of the engagement projections 21.

In the embodiment, each of the engagement holes 23 is throughly formed in the wall part of the second fitting part 7. However, the shape of each of the engagement holes 23 is not limited to this, and it may be formed in the form of a groove on the inner wall surface of the second fitting part 7. In this case, it is possible to cover the entire area of the outer circumferential surface of each of the engagement projections 21 and also possible to prevent the detective fitting part 19 from being opened furthermore.

In order to prevent the detective fitting part 19 from being opened, the connector 1 is provided with the opening preventive parts 25, in addition to the shapes of the engagement projections 21 and the engagement holes 23.

Each of the opening preventive parts 25 includes an opening preventive groove 67 provided on the U-shaped free end side of the detective fitting part 19 and an opening preventive rib 69 provided in the second housing 9 to engage with the opening preventive groove 67.

The opening preventive grooves 67 and the opening preventive ribs 69 are engaged with each other in the opening direction of the U-shaped detective fitting part 19 to prevent the detective fitting part 19 from being opened. Thus, this engagement between the opening preventive grooves 67 and the opening preventive ribs 69 allows the assembling state of the fitting detection member 11 to the second housing 9 to be stabilized by preventing a deformation of the fitting detection member 11.

In order to confirm the primary locking position of the fitting detection member 11 that moves between the temporary locking position and the primary locking position, the confirmation holes 27 and the confirmation projections 29 are provided in the fitting detection member 11 and the second housing 9, respectively.

The confirmation holes 27 are provided in the fitting detection member 11 and also provided on respective wall parts of a pair of frame parts 71, 71 in the vicinity of a pair of protection walls 59, 59 of the second housing 9, the wall parts of each frame part 71 being opposed to each other in the movement direction of the fitting detection member 11.

The confirmation holes 27 are formed so as to pierce the wall parts of the frame parts 71 in the movement direction of the fitting detection member 11 so that the interior side of the fitting detection member 11 can be visually recognized from the outside.

The confirmation projections 29 are provided in the pair of protection walls 59, 59 of the second housing 9 respectively. Also, in order to allow an insertion into the confirmation holes 27, each of the confirmation projections 29 is continuously formed so as to project from corresponding protection wall 59, in the form of a single member extending toward the confirmation holes 27.

When the fitting detection member 11 is positioned at the temporary locking position, the confirmation projections 29 are not inserted into the confirmation holes 27. However, when the fitting detection member 11 is positioned at the primary locking position, the confirmation projections 29 are inserted into the confirmation holes 27.

By visually confirming the presence or absence of an insertion of the confirmation projections 29 into the confirmation holes 27, it is possible to detect the secure locking position of the fitting detection member 11 and also possible to detect the fitting state between the first housing 5 and the second housing 9 reliably.

In the fitting detection member 11, the frame parts 71 are provided, on their upper surfaces, with lock holding parts 73 which are locked to both sides of the operating part 57 of the lock arm 55 in the width direction to hold the lock arm 55 when the fitting detection member 11 is positioned at the primary locking position.

Each of the lock holding parts 73 is provided, on its front side in the movement direction, with an inclined surface which abuts on the operating part 57 of the lock arm 55 when moving the fitting detection member 11 to the primary locking position to deflect the lock arm 55 downward and which is locked to the operating part 57 by upward restoring of the lock aim 55 when the fitting detection member 11 is positioned at the primary locking position.

By holding the operating part 57 of the lock arm 55 through the lock holding parts 73, it is possible to restrict the movement of the fitting detection member 11 from the primary locking position to the temporary locking position.

The operating part 57 of the locking arm 55 allows its engagement with the lock holding parts 73 to be released by pushing the operating part 57 downward with a predetermined pressing force, thereby allowing the fitting state between the first housing 5 and the second housing 9 to be cancelled.

Each of the frame part 71 of the fitting detection member 11 is arranged so as to cover the outer side surfaces of corresponding protection wall 59 and corresponding confirmation projection 29 in the width direction even if the fitting detection member 11 is in the temporary locking position.

In a case where each of the frame parts 71 of the fitting detection member 11 does not cover the outer surfaces of corresponding protection wall 59 and corresponding confirmation projection 29, there is a possibility that electric wires of the peripheral members enter between the confirmation projection 29 and the wall part defining the confirmation hole 27.

Such an entry of electric wires may cause the breakage of the lock arm 55 and the breakage of the fitting detection member 11. Additionally, when the fitting detection member 11 moves to the primary locking position, the electric wires and the lock arm 55 may interfere with each other to make it impossible for the lock arm 55 to be restored upward, thereby causing the possibility that the lock holding parts 73 and the operating part 57 are not engaged with each other, so that the fitting detection member 11 cannot be moved to the primary locking position.

Therefore, by covering the outer side surfaces of the protection walls 59 and the confirmation projections 29 with the frame parts 71, it is possible to prevent the electric wires from entering between each of the confirmation projections 29 and a wall part defining corresponding confirmation hole 27. As a result, it is also possible to prevent the breakage of the lock arm 55 and the breakage of the fitting detection member 11 and engage the lock holding part 73 and the operating part 57 with each other, thereby allowing the fitting detection member 11 to be held at the primary locking position.

In the connector 1, as the second fitting part 7 and the engaging part 15 are accommodated in the first fitting part 3, the engaging part 15 for holding the fitting detection member 11 at the temporary locking position and the primary locking position to the second housing 9 is not exposed to the outside, so that it is possible to prevent the engaging part 15 from being subjected to an external force due to its interference with the peripheral members or the like.

Therefore, with the connector 1, it is possible to suppress the influence of the fitting detection member 11 on the engaging part 15, thereby allowing the detection of the fitting state with the fitting detection member 11 to be performed stably.

Since the outer circumferential surface of the second fitting part 7 and the outer circumferential surface of the detective fitting part 19 are formed flush with each other, the interior of the first fitting part 3 can be miniaturized by reducing the swelling of the outer circumferential surfaces of the second fitting part 7 accommodated in the first fitting part 3 and the detective fitting part 19, thereby allowing the overall size of the connector 1 to be miniaturized.

As the tip side of each of the engagement projections 21 is engaged with corresponding engagement hole 23 at the temporary locking position of the fitting detection member 11 to the second housing 9, it is possible to accomplish the movement of the engagement detection member 11 from the temporary locking position to the primary locking position to the second housing 9 stably.

It is also possible to insert the second housing 9 into the first fitting part 3 of the first housing 5 smoothly.

As each of the engagement holes 23 provided in the second fitting part 7 covers at least a part of the outer circumferential surface of corresponding engagement projection 21 provided in the detective fitting part 19, the movement of the engagement projections 21 of the detective fitting part 19 to the outside can be restricted by the engagement holes 23 of the second fitting part 7 positioned outside the detective fitting part 19, thereby preventing the U-shaped detective fitting part 19 from being opened.

As the opening preventive parts 25 engaged in a substantially U-shaped opening direction of the fitting detection member 11 are provided between the second housing 9 and the U-shaped free end side of the fitting detection member 11, it is possible to prevent the fitting detection member 11 from being opened, thereby allowing the fitting detection member 11 to be held in the second housing 9 stably.

As the second housing 9 is provided, with the confirmation projections 29 to be inserted into the confirmation holes 27 at the primary locking position of the fitting detection member 11 to the second housing 9, it is possible to detect the fitting state between the first housing 5 and the second housing 9 by visually confirming the presence or absence of the confirmation projections 29 inserted into the confirmation holes 27.

Although the connector 1 according to the embodiment has the engagement projections 21 provided in the detective fitting part 19 and the engagement holes 23 provided in the second fitting part 7, the engagement projections 21 may be provided in the second fitting part 7, provided that the engagement holes 23 are provided in the detective fitting part 19.

By covering at least a part of the outer circumferential surface of each of the engagement holes 23 provided in the detective fitting part 19 with corresponding engagement projection 21 provided in the second fitting part 7, it is possible to prevent the U-shaped detective fitting part 19 from being opened.

Alternatively, both the engagement projections 21 and the engagement holes 23 may be provided in the second fitting part 7 and the detective fitting part 19 by providing the engagement projections 21 and the engagement holes 23 alternately in the circumferential direction of the second fitting part 7 and the detective fitting part 19.

What is claimed is:

1. A connector, comprising:

a first housing having a first fitting part;

a second housing having a second fitting part configured so as to be fittable to the first fitting part;

a fitting detection member assembled to an outer circumference of the second housing so as to be movable between a temporary locking position and a primary locking position;

an engaged part provided on the second fitting part; and an engaging part provided on the fitting detection member so as to be abuttable on the first fitting part, the engaging part being engaged to the engaged part to hold the fitting detection member at the temporary locking position and the primary locking position to the second housing, wherein the second fitting part and the engaging part are accommodated in the first fitting part.

2. The connector of claim 1, wherein:

at least one side of the fitting detection member is formed into a substantial U-shape; and the connector is provided, between the second housing and a substantially U-shaped free end side of the fitting detection member, with opening preventive parts which are engaged in a substantially U-shaped opening direction of the fitting detection member.

3. The connector of claim 1, wherein:

the fitting detection member is provided with a confirmation hole penetrating in a movement direction of the fitting detection member to the second housing; and the second housing is provided with a confirmation projection which is inserted into the confirmation hole at the primary locking position of the fitting detection member to the second housing.

4. The connector of claim 1, wherein:

the second fitting part is provided with a contracted part which is formed lower than an outer circumferential surface of the second fitting part;

the fitting detection member is provided with a detective fitting part which is arranged in the contracted part and fittable to an interior side of the first fitting part; and the outer circumferential surface of the second fitting part and an outer circumferential surface of the detective fitting part are formed flush with each other.

5. The connector of claim 4, wherein:

the fitting detection member is assembled to the second housing so as to be movable in a same direction as a fitting direction of the first housing and the second housing;

the second fitting part and the detective fitting part are provided, on their respective opposite surfaces in a moving direction of the fitting detection member, with an engagement projection extending in the moving direction and an engagement hole which is engageable with the engagement projection, respectively; and the engagement projection has its tip side engaged with the engagement hole at the temporary locking position of the fitting detection member to the second housing.

6. The connector of claim 5, wherein:

the detective fitting part is formed into a substantial U-shape; and one of the engagement projection and the engagement hole, which is provided in the second fitting part, is adapted so as to cover at least a part of an outer circumferential surface of the other one of the engagement projection and the engagement hole, which is provided in the detective fitting part.

* * * * *